US007040411B2

(12) United States Patent
Kainer et al.

(10) Patent No.: US 7,040,411 B2
(45) Date of Patent: May 9, 2006

(54) BOP HANDLING SYSTEM

(75) Inventors: Bryan Kainer, Beasley, TX (US); Baldwin Zahn, Houston, TX (US)

(73) Assignee: National-Oilwell, L.P., Houston, TX (US)

( * ) Notice: Subject to any disclaimer, the term of this patent is extended or adjusted under 35 U.S.C. 154(b) by 27 days.

(21) Appl. No.: 10/835,183

(22) Filed: Apr. 29, 2004

(65) Prior Publication Data

US 2004/0231857 A1 Nov. 25, 2004

Related U.S. Application Data

(60) Provisional application No. 60/467,508, filed on May 2, 2003.

(51) Int. Cl.
*E21B 19/24* (2006.01)
*B66F 9/16* (2006.01)
*B66F 9/14* (2006.01)

(52) U.S. Cl. ..... 166/379; 166/79.1; 166/85.4; 414/642; 414/666; 414/672

(58) Field of Classification Search ..... 166/379, 166/382, 85.4, 79.1; 414/642, 666, 672
See application file for complete search history.

(56) References Cited

U.S. PATENT DOCUMENTS 1,758,453 A 5/1930 Mays
4,291,762 A * 9/1981 Gudgel ..... 166/85.4
4,359,089 A 11/1982 Strate et al.
5,107,940 A 4/1992 Berry
5,121,793 A 6/1992 Busch et al.
5,411,085 A 5/1995 Moore et al.
5,816,565 A 10/1998 McGuffin
5,957,431 A 9/1999 Serda, Jr.
RE36,723 E 6/2000 Moore et al.
6,234,253 B1 5/2001 Dallas
6,315,052 B1 11/2001 Sola
6,494,268 B1 * 12/2002 Ljungdahl et al. ..... 166/379
6,902,007 B1 * 6/2005 Orr et al. ..... 166/379
2001/0052415 A1 12/2001 Coats et al.
2003/0010505 A1 1/2003 Gipson
2003/0079883 A1 5/2003 McCulloch et al.

OTHER PUBLICATIONS

H&P FlexRig (4 pgs.) Undated.

* cited by examiner

*Primary Examiner*—Jennifer H. Gay
(74) *Attorney, Agent, or Firm*—Conley Rose, P.C.

(57) ABSTRACT

Methods and apparatus for handling blowout preventer stacks. In one embodiment the handling system includes a cart, or skid, providing a base platform, a tilting frame, and a lifting frame. The stack is attached to the lifting frame, which is slidingly supported by the tilting frame, which pivots relative to the cart. The cart provides for positional adjustment of the stack in a first horizontal direction, while positional adjustment in a second, perpendicular horizontal direction is provided by a lateral adjustment mechanism coupling the tilting frame and the cart. The lifting frame can be moved vertically relative to the cart and also provides for rotational adjustment of the stack about its central axis.

24 Claims, 7 Drawing Sheets

BOP HANDLING SYSTEM

CROSS-REFERENCE TO RELATED APPLICATIONS

This application claims priority to U.S. Provisional Patent Application No. 06/467,508, filed May 2, 2003, and entitled "BOP Handling System," which is hereby incorporated by reference herein for all purposes.

STATEMENT REGARDING FEDERALLY SPONSORED RESEARCH OR DEVELOPMENT

Not applicable.

BACKGROUND OF THE INVENTION

The embodiments of the present invention relate generally to systems for handling blow out preventer (BOP) stacks. More particularly, the embodiments provide a system for transporting and handling a BOP stack during installation and removal from a wellhead.

Rigs used for drilling hydrocarbon wells are large, complex pieces of machinery. While drilling rigs used offshore are often integrated into a single, large platform, almost all rigs used to drill wells on land are designed to be disassembled, transported between drilling sites, and reassembled. Although some rigs may be designed to be moved by helicopter or airplane, the majority of rigs are moved by trucks and trailers. Thus, many land rigs are designed to disassemble into components suitable for transport.

The process of assembling a land rig for drilling operations is known as "rig up." During rig up, all of the various components of the drilling rig are assembled and tested prior to any drilling activity taking place. The rig up procedure may last anywhere from a couple of days to more than a week, depending on the type of rig being assembled and any problems encountered during the process. Because, drilling the well can not commence until rig up is complete it is desirable to minimize the time spent assembling the drilling rig.

The entire rig up process must be performed in reverse in order to disassemble, or "rig down," the rig for transportation to another location. The rig down procedures further add to the downtime that the rig spends between drilling wells. The amount of downtime spent between drilling wells is often limited by the contracts under which the rigs are operated such that any time beyond a certain limit will not be paid for by the rig lessee. Thus, any equipment or procedures available, which limit the amount of time needed for rig up and rig down activities, are desirable.

One of the most time consuming and labor intensive tasks during rig up and rig down is the handling of the blow out preventer (BOP) stack. BOP's are essentially large diameter, high pressure valves used to control flow out of the wellbore, a BOP stack often includes several individual BOP's assembled in series. In oilfield vernacular, the terms BOP, BOP stack, and stack are all used in referring to the BOP stack. The BOP is installed at the wellhead (beneath the drill floor) and all equipment and fluids traveling into or out of the well during drilling pass through the BOP. The BOP is the last line of defense in preventing the uncontrolled release of wellbore fluids at the surface, known as a blowout, and are therefore a critical piece of safety equipment on the rig. On large land rigs, the BOP may have a 13" or greater bore diameter and be rated for working pressures up to and exceeding 10,000 psi.

In normal operations, several individual BOP's are stacked on top of one another to form a "BOP stack." Typical stacks are tens of feet high and weigh in at tens of thousands of pounds. On most land rigs the stack is at least partially disassembled during transport because the rig has no practical means of transporting the fully assembled stack. The heavy-duty connections between individual BOP's within a stack often take hours to make or break, adding to the time needed for rig up or down.

Once the BOP is assembled, it must be positioned under the rig floor directly over the wellhead. This is often a delicate, time consuming operation because the large, heavy BOP stack must be moved underneath the already erected rig. The BOP must be centered on the axis of the well, which runs from the rotary table on the drill floor into the wellhead, thus potentially requiring position adjustment in two directions on the horizontal plane. The BOP stack must also be able to adjust vertically to compensate for differences in elevation of the wellhead. Furthermore, because the BOP stack normally attaches to the wellhead by a flange, which has a bolt pattern that must align with a corresponding bolt pattern on the BOP, the BOP must be allowed to rotate about its vertical axis in order to find the correct alignment with the wellhead.

Most BOP handling systems and methods currently being used involve transferring the BOP stack from one piece of equipment to another, such as from a skid to an overhead lifting system. Many of these overhead lifting systems, such as cranes or trolleys, involve lifting and suspending the BOP, which, like lifting any large load, consumes significant amounts of time and resources to perform safely.

Thus, there remains a need in the art for systems to increase the efficiency and safety of handling a BOP stack during rig up and rig down procedures. Therefore, the embodiments of the present invention are directed to methods and apparatus for providing for a BOP handling system that seeks to overcome the limitations of the prior art.

SUMMARY OF THE PREFERRED EMBODIMENTS

The preferred embodiments provide a system for handling a blow out preventer stack during transportation and installation. The handling system is a single unitized system that provides support for the stack while transporting in a horizontal position. During installation, the handling system moves the stack to a vertical position and provides for positional adjustment of the stack vertically, in two horizontal directions, and rotationally about the central axis of the stack. Hydraulic cylinders provide the forces needed to adjust the position of the stack. During handling and installation, the stack is never supported by an overhead lifting appliance or moved between one handling device and another.

In one embodiment the handling system includes a cart, or skid, providing a base platform, a tilting frame, and a lifting frame. The stack is attached to the lifting frame, which is slidingly supported by the tilting frame, which pivots relative to the cart. The cart provides for positional adjustment of the stack in a first horizontal direction, while positional adjustment in a second, perpendicular horizontal direction is provided by a lateral adjustment mechanism coupling the tilting frame and the cart. The lifting frame can be moved vertically relative to the cart and also provides for rotational adjustment of the stack about its central axis.

In certain embodiments, the cart is a wheeled cart adapted to ride on a set of rails. During transport the cart is secured on a transport skid having integral rails. The transport skid is offloaded and aligned with a set of rails installed underneath a rig. The cart is then rolled from the transport skid onto the rails until it underneath the rig and aligned with the wellhead. The stack is raised to vertical by the tilting frame and can then be adjusted and attached to the wellhead.'

In other embodiments, the cart has flat skids. Once the cart is offloaded, it is slid under the rig and aligned with the wellhead. No rails are required to move the cart under the rig. The stack can then be raised to vertical and installed on the wellhead.

Thus, the present invention comprises a combination of features and advantages that enable it to provide for a unitized stack handling system that allows a BOP stack to be transported, handled, and installed by a single piece of equipment safely and efficiently. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

DETAILED DESCRIPTION OF THE PREFERRED EMBODIMENTS

Figure 1:
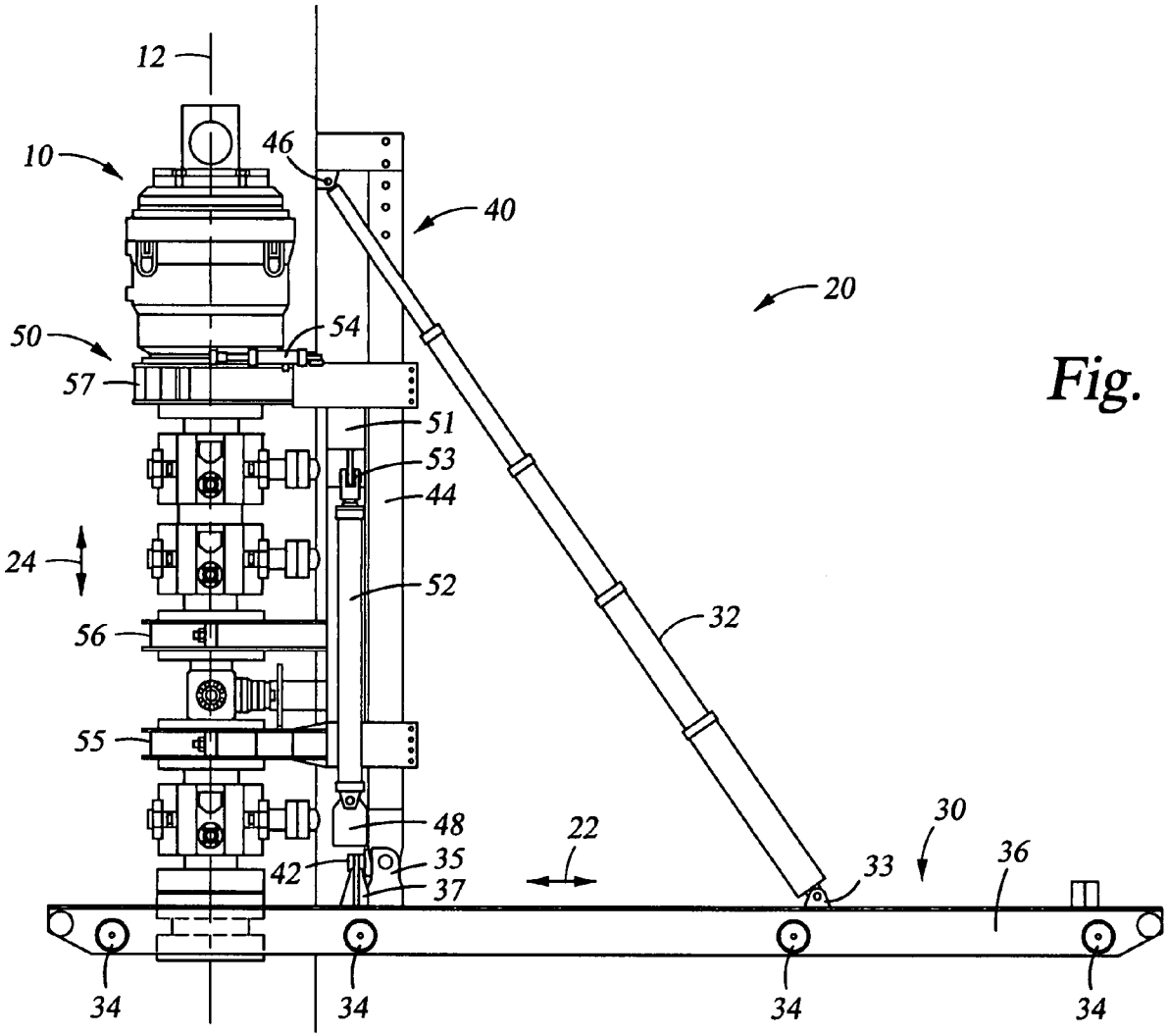
FIG. 1 is a side elevation view of one embodiment of a BOP handling system.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

In particular, various embodiments of the present invention provide a number of different methods and apparatus for handling a BOP stack during installation of a drilling rig. The concepts of the invention are discussed in the context of BOP handling for land rigs but the use of the concepts of the present invention is not limited to this particular application and may be applied to any BOP, or other heavy equipment, installation application. The concepts disclosed herein may find application with other rig types, such as jack-ups, floating rigs, and offshore platforms, as well as other applications to which the concepts of the current invention may be applied.

Figure 2:
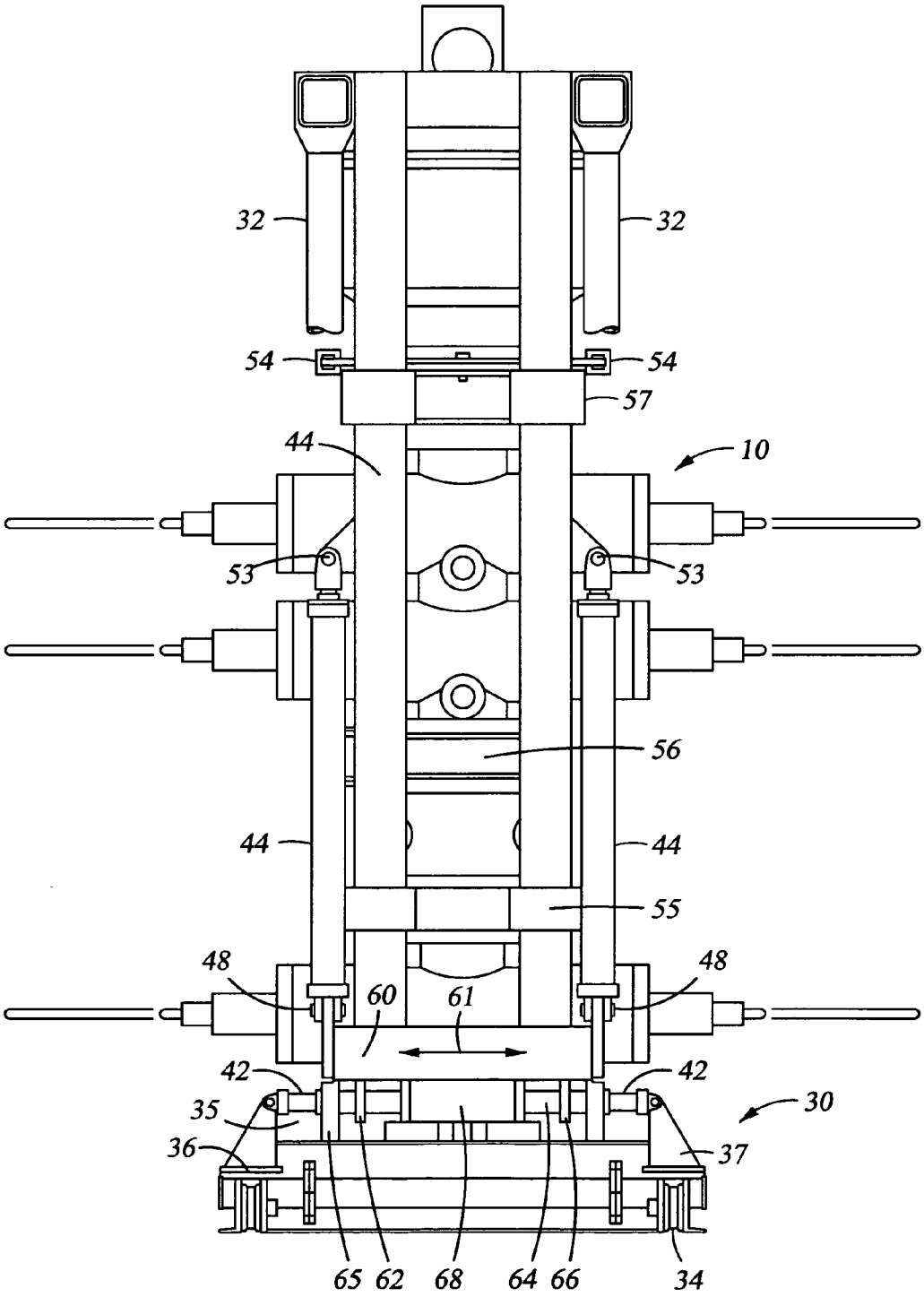
FIG. 2 is rear elevation view of the BOP handling system of FIG. 1.
Figure 3:
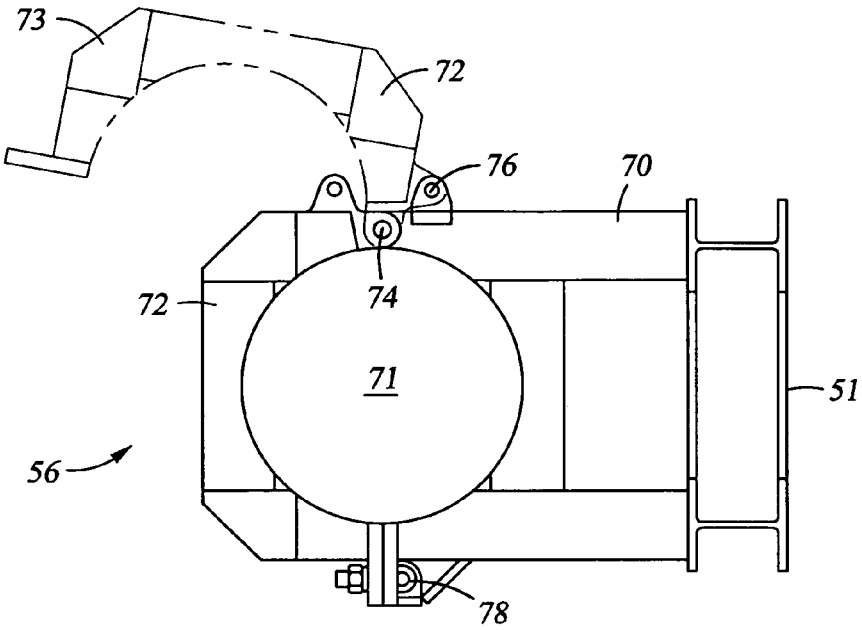
FIG. 3 is a plan view of the rotating support frame of the BOP handling system of FIG. 1.
Figure 4:
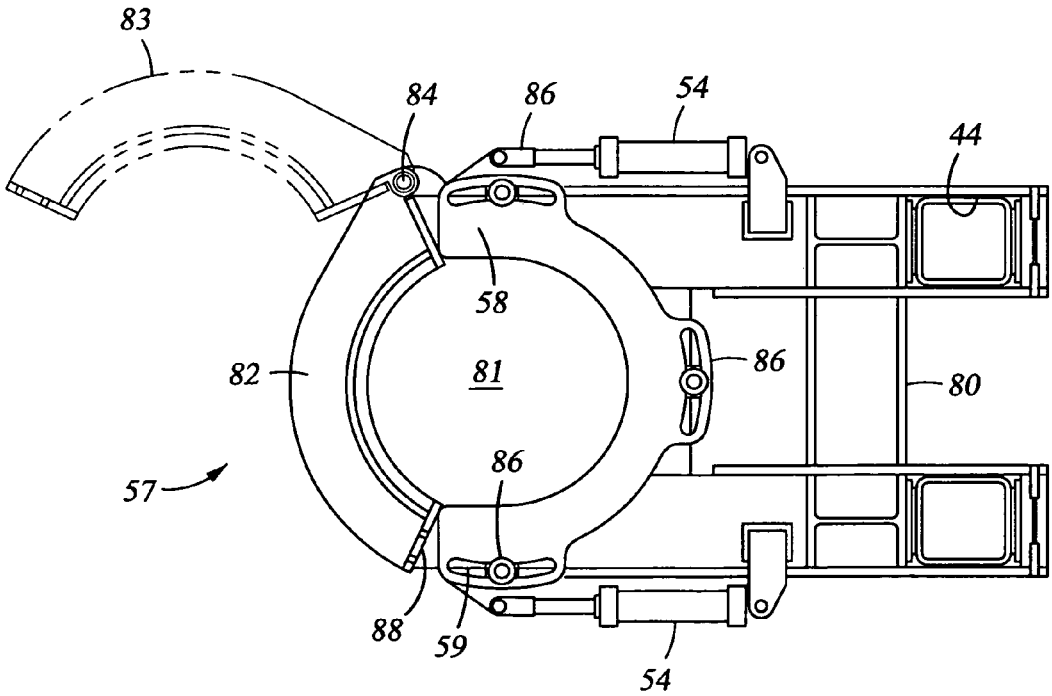
FIG. 4 is a plan view of one of the support frames of the BOP handling system of FIG. 1.
Figure 5:
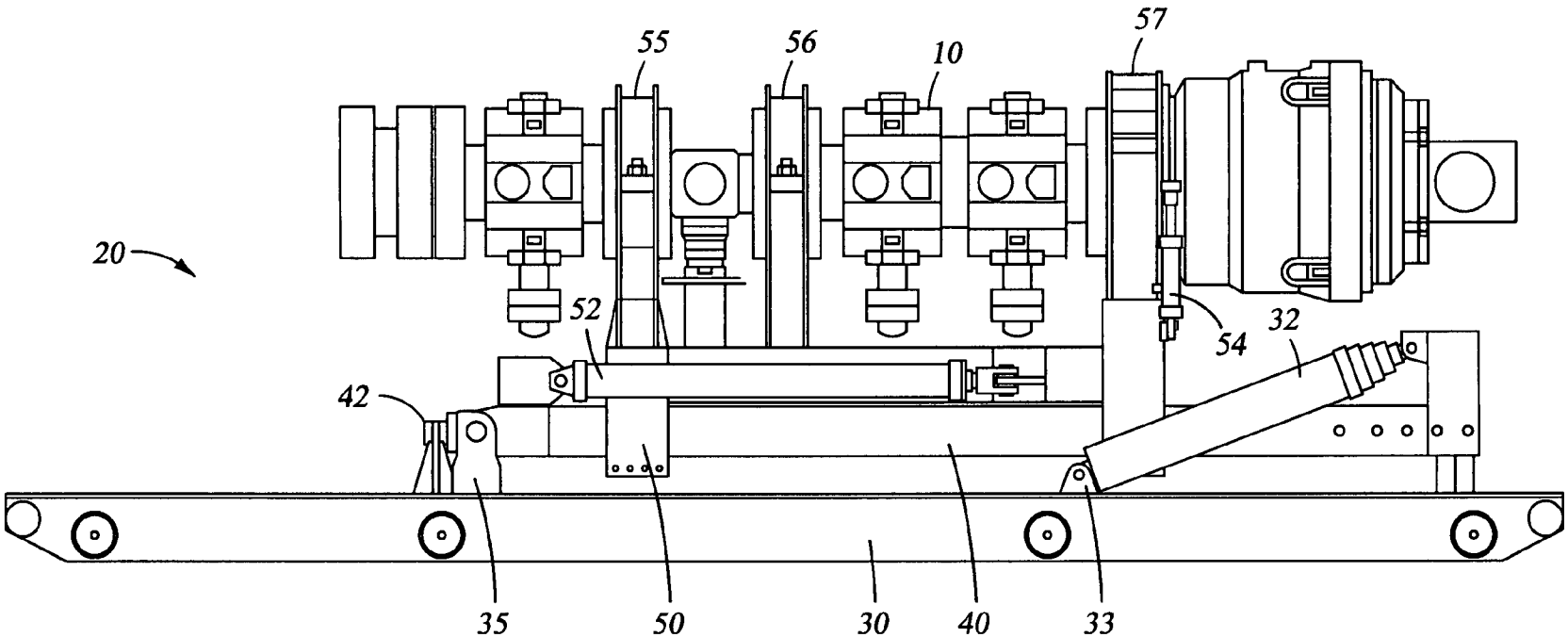
FIG. 5 is a side elevation view of the BOP handling system of FIG. 1, shown in the shipping position.
Figure 6:
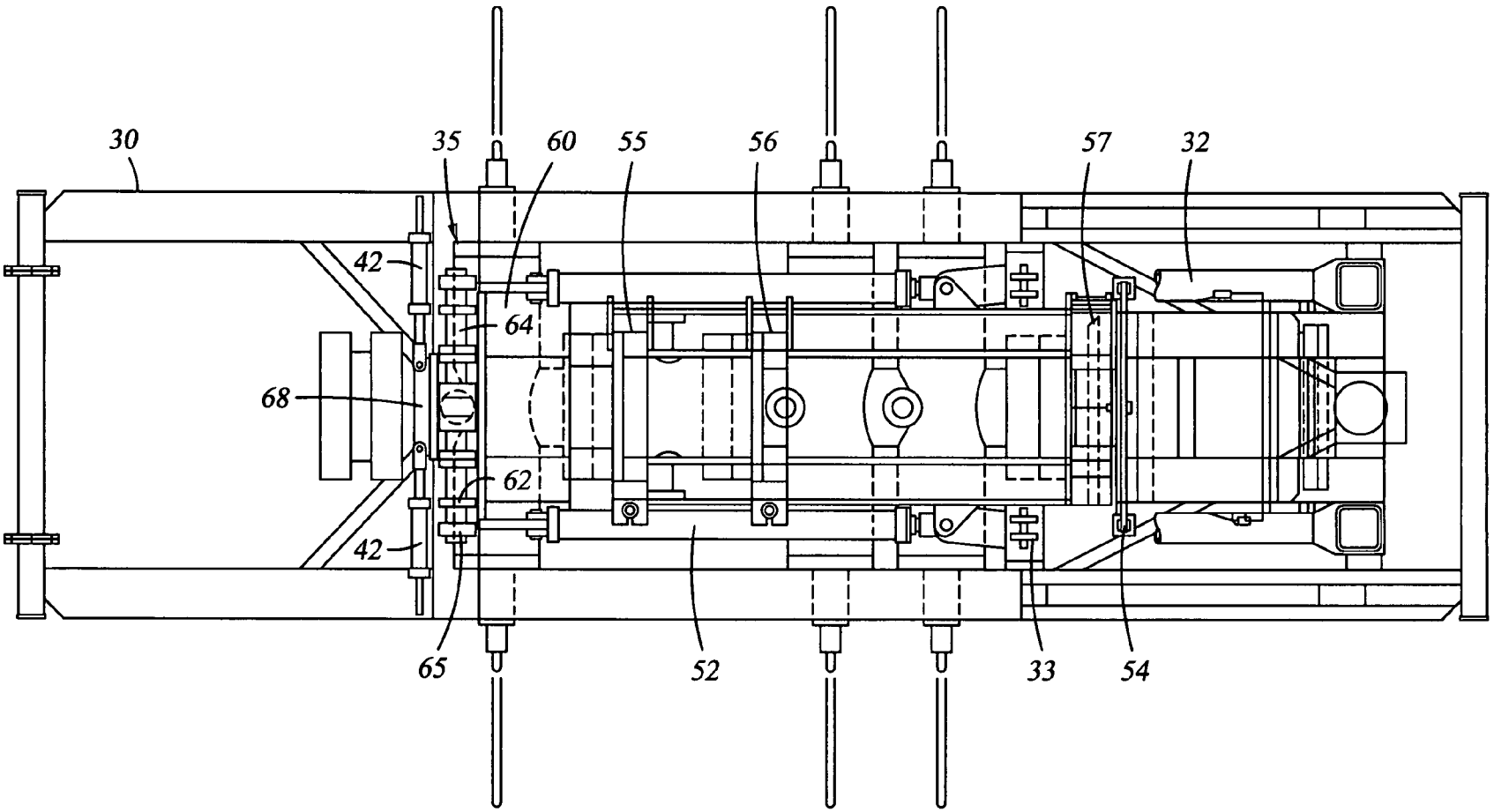
FIG. 6 is a top view of the BOP handling system of FIG. 1, shown in the shipping position.

One embodiment of a BOP handling system 20 is shown in FIGS. 1–6. FIGS. 1 and 2 show a BOP 10 vertically positioned for drilling or testing. FIGS. 3 and 4 show details of portions of the handling system 20. FIGS. 5 and 6 show BOP 10 horizontally positioned for shipping.

Referring now to FIG. 1 and FIG. 2, a BOP stack 10 is shown installed on a BOP handling system 20. The BOP handling system 20 generally includes a cart 30, tilting frame 40, and lifting frame 50. In the general operation of the handling system 20, cart 30 provides for positional adjustment of BOP 10 in a horizontal direction indicated as arrow 22. Tilting frame 40 supports BOP 10 as it is moved, by tilting cylinder 32, from a horizontal shipping position to a vertical working position, and allows for the positional adjustment of BOP 10, by lateral positioning cylinders 42, in a horizontal direction perpendicular to arrow 22. Lifting frame 50 allows for the positional adjustment of BOP 10, by lift cylinders 52, in the vertical direction of arrow 24 as well as rotational adjustment about BOP axis 12, by rotation cylinders 54.

Cart 30 serves as the base for handling system 20 and is formed on a generally rectangular skid-type structure 36 constructed of structural shapes and/or plate. Cart 30 is preferably configured and sized so as to be transported by truck, such as on a flatbed trailer. Cart 30 may include wheels 34 adapted to interface with a rail system (not shown) to reduce the force needed for horizontal positional adjustment of BOP 10. Cart 30 also includes tilting cylinder mounts 33, a tilting frame mount 35, and lateral positioning cylinder mounts 37.

FIG. 1 shows BOP 10 in a vertical position for drilling or testing operations. Tilting cylinders 32 have been fully extended to raise tilting frame 40. Although once BOP 10 is attached to a wellhead or test flange it will be secured in the vertical position, tilting frame 40 may also be locked in place by the attaching a cable or bar (not shown) between tilting frame 40 and cart 30. Referring now to FIG. 5, the BOP handling system 20 is shown with BOP 10 in a horizontal position for transporting. Tilting cylinders 32 are retracted so that tilting frame 40 is moved from a vertical position to a horizontal position where it is laying on cart 30.

Tilting frame 40 is preferably constructed from structural shapes and/or plate and includes a vertical frame 44 that is pivotally attached to cart 30 at tilting frame mount 35. Tilting frame 40 also includes tilting cylinder mounts 46 and lift cylinder mounts 48. The base 60 of tilting frame 40 includes interface plates 62 that receive shaft 64, which is retained by end mounts 65 attached to cart 30. In alternate embodiments, shaft 64 can be fixed to end mounts 65 and rotate within plates 62 or shaft 64 may be fixed to plates 62 and rotate within end mounts 65.

Tilting frame mount 35, in conjunction with lateral positioning cylinder mounts 37 and lateral positioning cylinders 42, also provides for lateral adjustment of the position of BOP 10 in the direction indicated by arrow 61. As best seen in FIG. 6, lateral positioning cylinders 42 are attached between cylinder mounts 37 and adjustment frame 68, which receives shaft 64 and fits between two interface plates 62. As cylinders 42 extend and retract, adjustment frame 68 is moved, causing tilting frame 40 to move up to a distance 66 between the outermost interface plate 62 and end mounts 65.

Referring back to FIG. 1, lifting frame 50 is also constructed from structural shapes and/or plate and is adapted to slidingly engage tilting frame 40 and be vertically supported by lift cylinders 52, which are attached at cylinder mounts 53. Lifting frame 50 includes a vertical structure 51 to which lower support frame 55, middle support frame 56, and upper support frame 57 are attached. The support frames 55, 56, 57 attach to BOP 10, preferably at the BOP's flange connections, and supports the BOP during transportation and installation. Upper support frame 57 also supports rotating support plate 58, which is rotated relative to upper support frame 57 by rotation cylinders 54.

Referring now to FIG. 3, a top down view of middle support frame 56 is shown. Middle support frame 56 is identical to lower support frame 55 except that lower support frame 55 includes structure tying the frame to vertical frame 44 while middle support frame 56 is attached directly to vertical frame 51. Middle support frame 56 includes base portion 70 and an arcuate hinged door 72 that combine to form a circular enclosure 71 for accommodating BOP 10. Hinge 74 allows door 72 to be moved from an open position 73 wherein the door can be held open by pin connection 76. In the closed position, bolted connection 78 securely attaches door 72 to base 70.

Referring now to FIG. 4, upper support frame 57 is shown including rotating support plate 58 and rotation cylinders 54. Upper support frame 57 includes base portion 80 and an arcuate hinged door 82 that combine to form a circular enclosure 81 for accommodating BOP 10. Hinge 84 allows door 82 to be moved from an, open position 83 and a closed position where bolted connection 88 securely attaches door 82 to base 80. Bolts or pins 86, protrude from the upper surface of upper support frame 57 and interface with slots 59 in rotating support plate 58.

When BOP 10 is in the vertical position, and not installed on the wellhead or a test flange, the weight of BOP 10 rests on support plate 58. Rotation cylinders 54 are actuated in an opposing manner such that the extension of one cylinder is coincident with the retraction of the other cylinder. This opposing actuation causes support plate 58 to rotate about the center of enclosure 81. Because BOP 10 is being supported by plate 58, the BOP also rotates about its central axis. This rotation is critical to allow the alignment of the bolt pattern on the base flange of BOP stack 10 to align with the bolt pattern on the wellhead flange.

Figure 7:
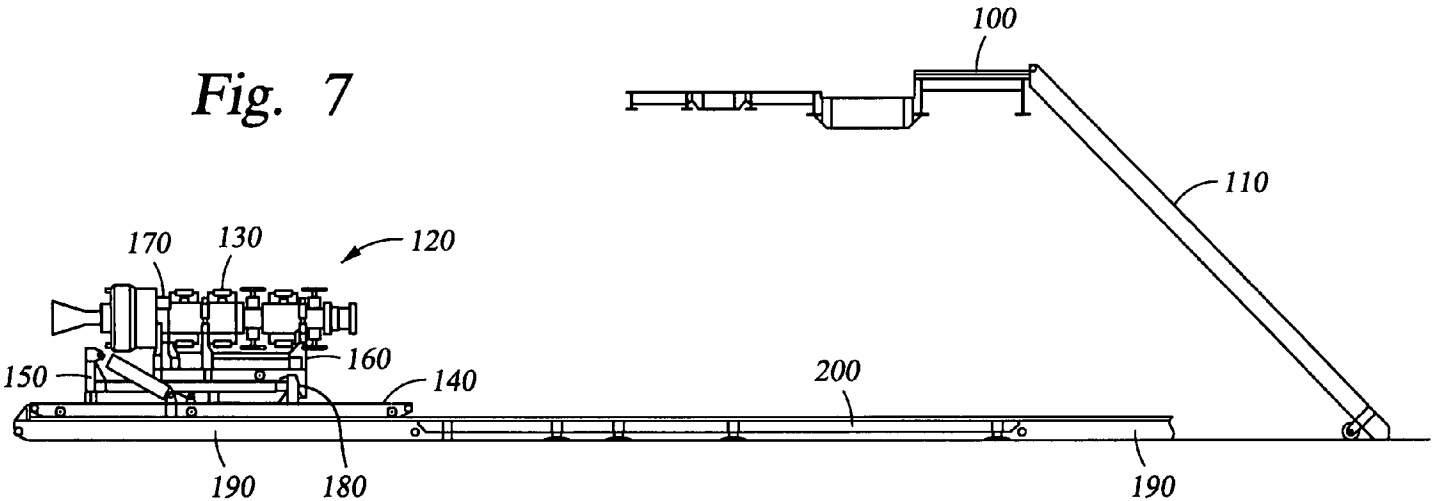
FIG. 7 is a first elevation view of a BOP being installed on a rig.
Figure 9:
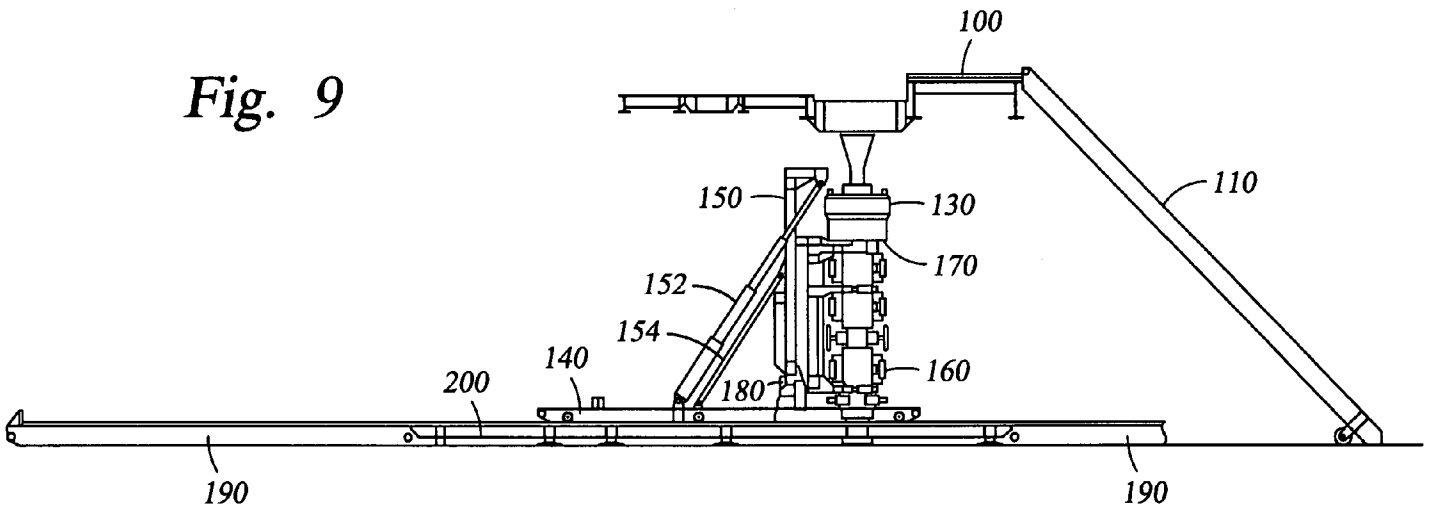
FIG. 9 is a second elevation view of the BOP of FIG. 7 being installed on a rig.
Figure 8:
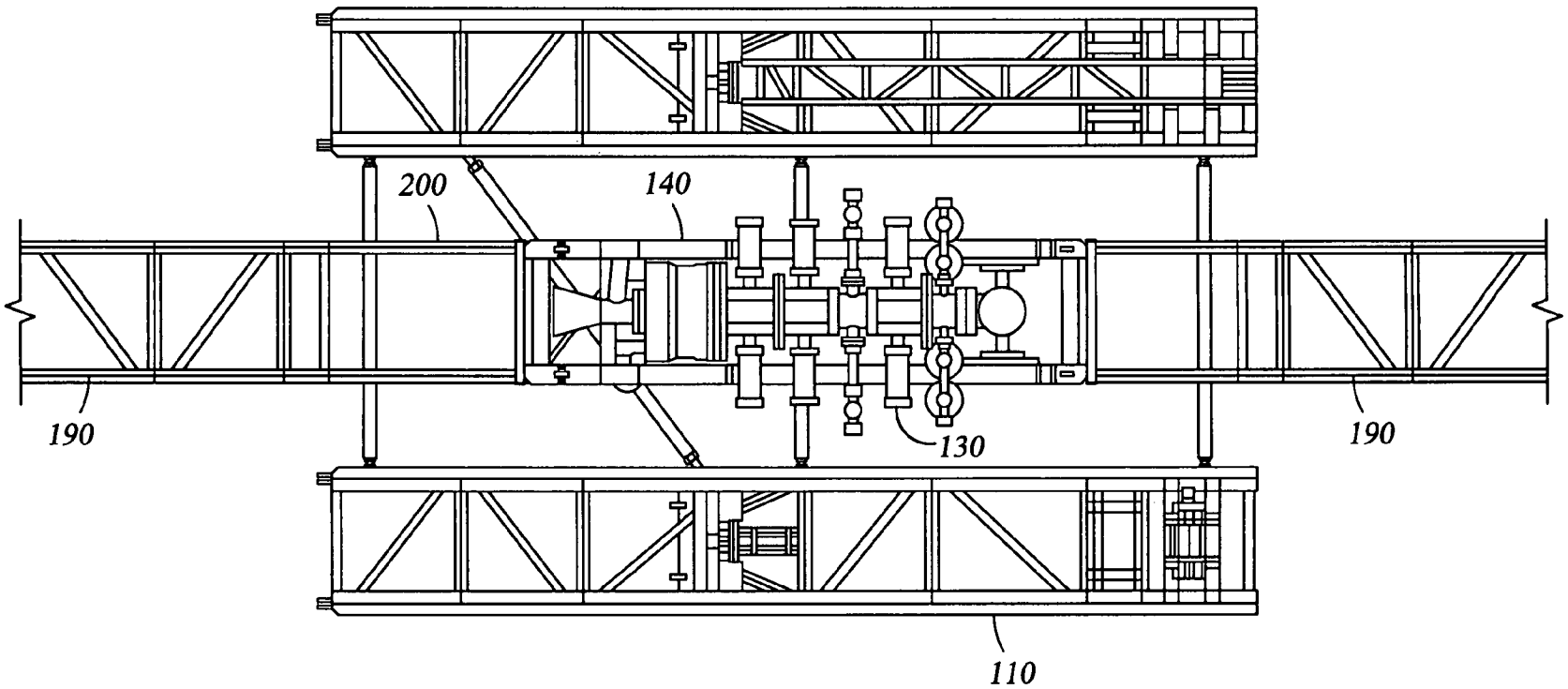
FIG. 8 is a top view of the BOP installation of FIG. 7.

FIGS. 7–9 show a BOP 130 being installed on a rig beneath a drill floor 100, which is supported by rig structure 110. FIG. 7 shows BOP 130 installed on a BOP handling system 120. Handling system 120 includes a cart 140, a tilting frame 150, a lifting frame 160, a rotating support 170, and a lateral shifting system 180. Cart 140 may preferably be wheeled and adapted to be transported on a transport skid 190 that has integral rails adapted to interface with the wheels of cart 140. In alternate embodiments, cart 140 may be a simple skid and not utilize a transport skid 190.

Handling system 120, with BOP 130 installed, is transported, such as by truck, on transport skid 190. Cart 140 rides on rails integrated into skid 190 and is fixed to the skid during transport to prevent cart 140 from rolling. Once handling system 120 arrives at a drilling site, the system, including BOP 130 and transport skid 190 is offloaded and aligned with installation rails 200 in place under drill floor 100. Transport skid 190 may be placed at either end of rails 200.

Cart 140 is released from transport skid 190 and handling system 120 is rolled to the proper position under the drill floor, as is shown in FIG. 8. Air tuggers, winches, or other equipment may be used to move handling system 120 to the proper position. In those embodiments in which cart 140 is not wheeled, system 120 is simple dragged along the ground until it is properly positioned under the drill floor.

Once cart 140 is satisfactorily positioned, tilting cylinder 152 is extended to rotate tilting frame 150 from a horizontal horizontal to a vertical position, as shown in FIG. 9. Once BOP 130 is vertical, lifting frame 160 can be used to adjust the vertical position of the BOP relative to the wellhead or test flange. Lateral shifting system 180 provides adjustment of the position of BOP 130 in a horizontal direction perpendicular to the direction cart 140 moves, and cart 140 can be further moved to fine tune the position of BOP relative to the wellhead or test flange. Rotating support 170 is provided to allow rotational alignment between the mating bolt patterns of BOP 130 and the wellhead or test flange to which it connects. Retaining member 154 can be connected between cart 140 and tilting frame 150 to further support BOP 130 once installation is complete.

In the preferred embodiments, the position of BOP 130 is achieved through hydraulic control of the various positioning functions. In this manner, a single control panel could be provided allowing a single operator to position BOP 130 from a remote location. BOP handling system 120 also eliminates the need for shifting the load of BOP 130 between different lifting or handling appliances and the BOP is never suspended from an overhead lifting appliance.

Another advantage of BOP handling system 120 is that, since BOP 130 is transported and installed fully assembled, the connections between components of the BOP stack do not have to be made or broken during a rig move. Additionally, the hydraulic hoses and plumbing supplying hydraulic functions on BOP stack 130 can also remain installed, potentially simplifying the connection of the BOP to the rig control system.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A blowout preventer stack handling system comprising:

a cart;

a tilting frame pivotally connected to said cart;

a lifting frame slidably connected to said tilting frame, wherein said lifting frame is operable to connect to a blowout preventer stack; and a rotating mechanism connected to said lifting frame and operable to rotate the blowout preventer stack about its longitudinal axis.

2. The handling system of claim 1 further comprising a rotation cylinder connected between said rotating mechanism and said lifting frame, wherein said rotation cylinder is operable to rotate the blowout preventer about its longitudinal axis.

3. The handling system of claim 1 further comprising a tilting cylinder connected to said tilting frame and said cart, wherein said tilting cylinder is operable to pivot said tilting frame relative to said cart.

4. The handling system of claim 1 further comprising a lateral positioning cylinder connected between said tilting frame and said cart, wherein said lateral positioning cylinder is operable to move said tilting frame in a direction perpendicular to the longitudinal axis of the blowout preventer stack.

5. The handling system of claim 1 further comprising a lift cylinder connected between said tilting frame and said lifting frame, wherein said lift cylinder is operable to slide said lifting frame relative to said tilting frame.

6. The handling system of claim 1 further comprising wheels mounted to said cart.

7. The handling system of claim 6 further comprising a rail system operable to interface with said wheels of said cart.

8. A blowout preventer stack handling system comprising:

a cart a tilting frame pivotally connected to said cart;

a lifting frame slidably connected to said tilting frame, wherein said lifting frame is operable to connect to a blowout preventer stack; and wherein said lifting frame comprises:

a main structure;

a lower support frame attached to said main structure and operable to connect to the blowout preventer stack;

an upper support frame attached to said main structure and operable to connect to the blowout preventer stack; and a rotating support plate supported by said upper support frame and operable to rotate relative to said upper support frame.

9. The handling system of claim 8 wherein said upper support frame and said lower support frame are slidably engaged with said tilting frame.

10. The handling system of claim 9 further comprising a middle support frame attached to said main structure between said upper and lower support frames.

11. The handling system of claim 10 wherein said middle support frame is not engaged with said tilting frame.

12. The handling system of claim 8 further comprising a rotation cylinder connected between said rotating support plate and said lifting frame, wherein said rotation cylinder is operable to rotate the blowout preventer about its longitudinal axis.

13. The handling system of claim 8 further comprising a tilting cylinder connected to said tilting frame and said cart, wherein said tilting cylinder is operable to piviot said tilting frame relative to said cart.

14. The handling system of claim 8 further comprising a lateral positioning cylinder connected between said tilting frame and said cart, wherein said lateral positioning cylinder is operable to move said tilting frame in a direction perpendicular to the longitudinal axis of the blowout preventer stack.

15. The handling system of claim 8 further comprising a lift cylinder connected between said tilting frame and said lifting frame, wherein said lift cylinder is operable to slide said lifting frame relative to said tilting frame.

16. The handling system of claim 8 further comprising wheels mounted to said cart.

17. The handling system of claim 16 further comprising a rail system operable to interface with said wheels of said cart.

18. A blowout preventer stack handling system comprising:

a pair of rails disposed between a storage location and an installation location;

a transportable cart having wheels operable to engage said pair of rails;

a first handling apparatus operable to pivot a blowout preventer stack from a horizontal position to a vertical position;

a second handling apparatus operable to adjust the vertical position of the blowout preventer stack;

a third handling apparatus operable to adjust the position of the blowout preventer stack in a direction perpendicular to said pair of rails; and a fourth handling apparatus operable to rotate the blowout preventer stack about its longitudinal axis.

19. The handling system of claim 18 wherein said first handling apparatus comprises:

a tilting frame pivotally connected to said transportable cart; and a tilting cylinder connected to said tilting frame and said transportable cart.

20. The handling system of claim 19 wherein said second handling apparatus comprises:

a lifting frame slidably connected to said tilting frame; and a lifting cylinder connected to said lifting frame and said tilting frame.

21. The handling system of claim 20 wherein said third handling apparatus comprises a lateral positioning cylinder connected to said tilting frame and to said transportable cart.

22. The handling system of claim 21 wherein said fourth handling apparatus comprises:

a rotating support plate connected to said lifting frame; and a rotating cylinder connected between said rotating support plate and said lifting frame.

23. A method for handling a blowout preventer stack comprising:

disposing the stack in a handling system;

transporting the stack in a horizontal orientation;

moving the stack to an initial position above a wellhead;

pivoting the stack to a vertical orientation;

aligning the stack to the wellhead, wherein the stack is pivoted and aligned using the handling system; and wherein aligning the stack to the wellhead comprises:

adjusting the vertical position of the stack along its longitudinal axis;

adjusting the lateral position of the stack in a direction perpendicular to its longitudinal axis; and rotating the stack about its longitudinal axis.

24. The method of claim 23 wherein the stack remains connected to the handling system during drilling operations.

* * * * *

UNITED STATES PATENT AND TRADEMARK OFFICE
Certificate

Patent No. 7,040,411 B2 Patented: May 9, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Bryan Kainer, Beasley, TX (US); Baldwin Zahn, Houston, TX (US); and Kam Konduc, Edmonton, Alberta, Canada.

Signed and Sealed this Twenty-third Day of September 2008.

JENNIFER H. GAY
*Supervisory Patent Examiner*
Art Unit 3676